US005272887A

United States Patent [19]

Zendzian, Sr.

[11] Patent Number: 5,272,887

[45] Date of Patent: Dec. 28, 1993

[54] PORTABLE REFRIGERATION HOLD-OVER PACK

[76] Inventor: Peter R. Zendzian, Sr., 7928 West Dr. PH7, N. Bay Village, Fla. 33141

[21] Appl. No.: 928,877

[22] Filed: Aug. 11, 1992

[51] Int. Cl.[5] ..... F25D 19/00

[52] U.S. Cl. ..... 62/295; 62/240; 62/434; 62/515

[58] Field of Search ..... 62/295, 297, 299, 430, 62/434, 515, 240

[56] References Cited

U.S. PATENT DOCUMENTS

| | | | |
|---|---|---|---|
| 2,188,349 | 1/1940 | Heideman . | |
| 2,248,607 | 7/1941 | Cooper . | |
| 2,416,015 | 2/1947 | McGuffey . | |
| 2,585,360 | 2/1962 | Williams | 62/299 |
| 2,769,310 | 11/1956 | Stickland . | |
| 2,795,114 | 6/1957 | Kleist . | |
| 2,875,595 | 3/1959 | Kleist . | |
| 3,507,322 | 4/1970 | Tetrick et al. | 62/299 |
| 3,721,104 | 3/1973 | Adler . | |
| 3,845,638 | 11/1974 | Apple, Jr. et al. . | |
| 4,114,396 | 9/1978 | Rickert . | |
| 4,354,359 | 10/1982 | Hall et al. | 62/438 |

OTHER PUBLICATIONS

Advertisement for Cold-Cel ® Holdover Truck Plates by Dole Engineering.

Advertisement for Coldbank TM Holdover Plates by Adler-Barbour.

Advertisement for Stock Coldbanks by Adler-Barbour.

Advertisement for Coldpump.

Advertisement for A Coldmachine TM by Adler-Barbour.

Advertisement for Marine Refrigeration Systems by Technautics.

Advertisement for Marine Refrigeration by Frigoboat.

Advertisement for Eutectic Holding Plates by Fleming Marine U.S.A., Inc.-Aust.

Advertisement for Frigoboat Holding Plates from Italy.

*Primary Examiner*—Ronald C. Capossela

*Attorney, Agent, or Firm*—Dority & Manning

[57] ABSTRACT

A refrigeration holding pack for use with a refrigeration system is provided for providing nonobtrusive hold-over refrigeration capability to the refrigeration system. The holding pack is configured to be externally mounted to the refrigeration coil assembly of the refrigeration system without the necessity of breaking into the refrigeration cycle of the system. The holding pack includes a sealable plate having a plurality of heat transfer fins disposed therein. A hold-over refrigeration system for use on recreational vehicles and marine vessels is also provided. The system employs a holding pack configured to be secured against a refrigeration coil assembly. The holding pack may be portable in nature or secured to the coil assembly in a more permanent type arrangement.

17 Claims, 3 Drawing Sheets

PORTABLE REFRIGERATION HOLD-OVER PACK

BACKGROUND OF THE INVENTION

The present invention relates to a cold storage or hold-over pack for use with a refrigeration system and more particularly to a portable hold-over pack for use with existing refrigeration systems on, for example, marine vessels, recreational vehicles, and household refrigeration systems.

Eutectic holding plates are well known in the art. These devices are referred to as "holding plates" or "holdover plates" because they provide continued cooling action to a compartment once their associated refrigeration systems are turned off. These conventional holding plates, however, have freon or refrigeration coils located internal to their structure. In other words, the refrigerant flows through tubes or passages within the holding plate. In use with a refrigeration system, the conventional holding plate actually comprises a portion of the freon cycle. If any damage occurs to these holding plates, the entire volume of refrigerant must be emptied or evacuated from the system. This process inevitably leads to some refrigerant being released into the atmosphere, which is a major ecological concern.

Industrial and commercial freon leaks, including leaks from residential and marine refrigeration systems, are believed to be a major contributor to the deterioration of the earth's ozone layer. Federal policies have been enacted to curtail the discharge of refrigerant into the atmosphere and, as a consequence thereof, refrigeration and air conditioning businesses will need expensive vacuum recovery systems to minimize the discharge of refrigerants into the air.

The conventional holding plates also have the disadvantage that, in order to repair or replace the holding pack, the entire refrigeration system must be shut down and the refrigerant evacuated from the system prior to breaking into the system to change out or repair the holding pack. Additionally, the system is limited to the number of holding packs initially configured in the system. In other words, another holding pack could not be added to the system once operation has begun without shutting down the system and evacuating the refrigerant.

The conventional holding plates are further limited in that they are generally sealed eutectic systems. In other words, the plate is initially filled with a certain eutectic solution and thereafter permanently sealed. Different eutectic solutions have different thermal characteristics. A particular eutectic solution can be chosen for its desired freezing point depending upon the purpose the holding plate is to be used for. The eutectic solution used in a cold storage holding plate, for example, freezes at a much higher temperature then the eutectic solution used in a freezer holding plate. With the conventional plates, once the plate is initially filled and installed in the refrigeration system, it is generally limited to use as a particular type of holding plate depending on the particular eutectic solution it was initially filled with, for instance a cold storage plate only.

Examples of commercially available conventional holding plates include the Cold-Cel® by Dole Engineering; the Coldbank TM by Adler-Barbour offered in a variety of sizes; and the Cold Plates offered by Fleming Marine USA, Inc.

Examples of some known prior art devices are shown in the following patents: U.S. Pat. No. 2,416,015 to McGuffey, U.S. Pat. No. 2,795,114 to Kleist, and U.S. Pat. No. 2,769,310 to Strickland refer to holding plates or heat exchange devices in general; U.S. Pat. No. 2,188,349 to Heideman, U.S. Pat. No. 2,248,607 to Cooper, and U.S. Pat. No. 3,845,638 to Apple et al. pertain to holding plate refrigeration systems in general; U.S. Pat. No. 3,721,104 to Adler references a marine refrigeration and cool storage system employing a container with a eutectic solution disposed therein and means for freezing the solution; U.S. Pat. No. 4,114,396 to Rickert discloses a refrigeration system evaporator coil having a series of heat exchange surfaces; and U.S. Pat. No. 2,875,595 to Kleist discloses a eutectic blower system for refrigerator spaces.

OBJECTS AND SUMMARY OF THE INVENTION

It is a principle object of the present invention to provide an improved holding pack which can be utilized with a conventional refrigeration system without breaking into the refrigeration system.

A further object of the present invention is to provide a portable holding pack that can be mounted to an existing refrigeration coil assembly without the necessity of breaking into the refrigeration system.

Still a further object of the present invention is to provide a versatile refrigeration holding pack which can be changed into and out of a refrigeration system without having to shut the refrigeration system down.

Yet a further object of the present invention is to provide a refrigeration holding pack that can be repaired or drained and filled with eutectic solution without causing refrigerant leaks into the atmosphere.

It is also an object of the present invention to provide a portable holding pack that can provide varying degrees of cooling capability.

Still a further object of the present invention is to provide a refrigeration holding pack which can be incorporated into an existing refrigeration system yet function externally thereto.

Also an object of this invention is to provide a holding pack having enhanced heat transfer capabilities.

And yet another object of the present invention is to provide a holding pack that can be selectively filled and drained with varying eutectic solutions without the necessity of shutting down the refrigeration system.

Also an object of the invention is to provide a hold-over refrigeration pack for use on recreational vehicles and marine vessels.

Still a further object of this invention is to provide a hold-over refrigeration system having a holding pack which operates external to the system's refrigeration cycle.

And still a further object of this invention is to provide a versatile refrigeration system for use on recreational vehicles and marine vessels having hold-over capability of acting as a cold storage unit, freezer, or deep freeze system.

Additional objects and advantages of the invention will be set forth in part in the description which follows and in part will be obvious from the description or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a refrigeration holding pack for use with a refrigeration system employing a refrigeration coil assembly is provided. The holding pack according to the invention provides nonobtrusive holdover cooling action while remaining external to the refrigeration system. The holding pack is "nonobtrusive" in that it remains external to the refrigeration system. There is no need to break into the existing refrigeration system to utilize the holding pack according to the present invention. The holding pack comprises a sealable plate having a first side for mounting against the refrigeration coil assembly and a second side, the plate adapted to hold a eutectic solution therein; a plurality of heat transfer fins disposed within the plate and oriented between the first side and the second side thereof, at least one of the heat transfer fins also being disposed in physical contact with the front side of the plate; and mounting means for removably securing the plate to the refrigeration coil assembly such that the first side is in physical contact against the refrigeration coil assembly so that upon operation of the refrigeration system, refrigerant passing through the coil assembly cools the eutectic solution within the plate whereby upon ceasing operation of the refrigeration system, the plate continues to provide cooling action to, for example, an insulated compartment.

In one preferred embodiment of the invention, the sealable plate further comprises an access port disposed therein for allowing the sealable plate to be selectively filled and drained with different eutectic solutions.

And in still a further preferred embodiment of the invention, the sealable plate further comprises a sealed thermal well disposed therein extending into the interior volume of the sealable plate and within which may be fitted or inserted a temperature monitoring device for determining the condition of the eutectic solution within the plate.

To further achieve the objects and in accordance with the purposes of the present invention, a portable recreational refrigeration holding pack for use with a recreational refrigeration system is provided. The portable refrigeration holding pack provides nonobtrusive enhanced hold-over cooling capability to the recreational refrigeration system while remaining external to the refrigeration system. The holding pack according to this embodiment comprises a sealable container having a contact side and a front side; a plurality of heat transfer fins disposed within the container with at least one of the fins in physical contact with at least one of the contact side of the container; an eutectic solution within the sealable container, the solution having predetermined thermal characteristics suited for the purpose the holding pack is to be used for; a pluggable access port disposed in the sealable container for selectively filling and draining the sealable container with the eutectic solution; and a mounting device operatively affixed to the sealable container for removably securing the contact side of the container against the refrigeration coil assembly so that upon operation of the refrigeration system, refrigerant passing through the refrigeration coil assembly absorbs heat from the eutectic solution causing the solution to cool a pre-determined amount depending on the specific eutectic solution chosen, whereby the holding pack will continue to cool the compartment when the refrigeration system is turned off.

In one preferred embodiment of the present invention, the holding pack is configured as a cold storage hold-over pack.

And in still another preferred embodiment, the holding pack according to the present invention is configured as a refrigeration hold-over pack.

And in still a further preferred embodiment of the holding pack according to the present invention, the holding pack is configured as a freezer hold-over pack.

In yet a further preferred embodiment, the holding pack according to the present invention is configured as a deep-freeze hold-over pack.

To achieve the objects and in accordance with the purpose of the invention, a hold-over refrigeration system for use on recreational vehicles and marine vessels is provided. The refrigeration system comprises a refrigeration cycle, the cycle further comprising a compressor; a condenser in operative communication with the compressor; a refrigeration coil assembly in operative communication with the compressor and the condenser; and refrigerant circulated through the coil assembly and cooled by operation of the condenser and the compressor. The hold-over refrigeration system further includes an insulated compartment within which the refrigeration coil assembly is disposed; at least one portable holding pack, the holding pack adapted to be removably mounted upon the refrigeration coil assembly. The holding pack comprises a sealable container having a contact side and a front side; a plurality of heat transfer fins disposed within the sealable container and in physical contact with the front side and the contact side; a pre-determined eutectic solution stored within the sealable container, the solution selected for its desired thermal characteristics; a pluggable access port disposed within the sealable container for selectively filling and draining the sealable container with the eutectic solution; and mechanical mounting means operatively affixed to the sealable container for removably securing the contact side of the container against the refrigeration coil assembly so that upon operation of the refrigeration cycle, the refrigerant circulating through the refrigeration coil assembly cools the insulated compartment while simultaneously absorbing heat from the eutectic solution within the sealable container. This process causes the eutectic solution to cool a desired amount whereby the holding pack can provide hold-over cooling capability to the insulated compartment once the refrigeration cycle is turned off.

In an alternative preferred embodiment of the refrigeration system according to the invention, a plurality of the holding packs are provided wherein a combination of the holding packs may be removably mounted upon the refrigeration coil assembly to provide any varying degree of hold-over refrigeration capability to the insulated compartment.

The accompanying drawings, which are incorporated in and constitute a part of the specification, illustrate one embodiment of the invention, and together with the description serve to explain the principles of the invention.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures in which.

Figure 1:
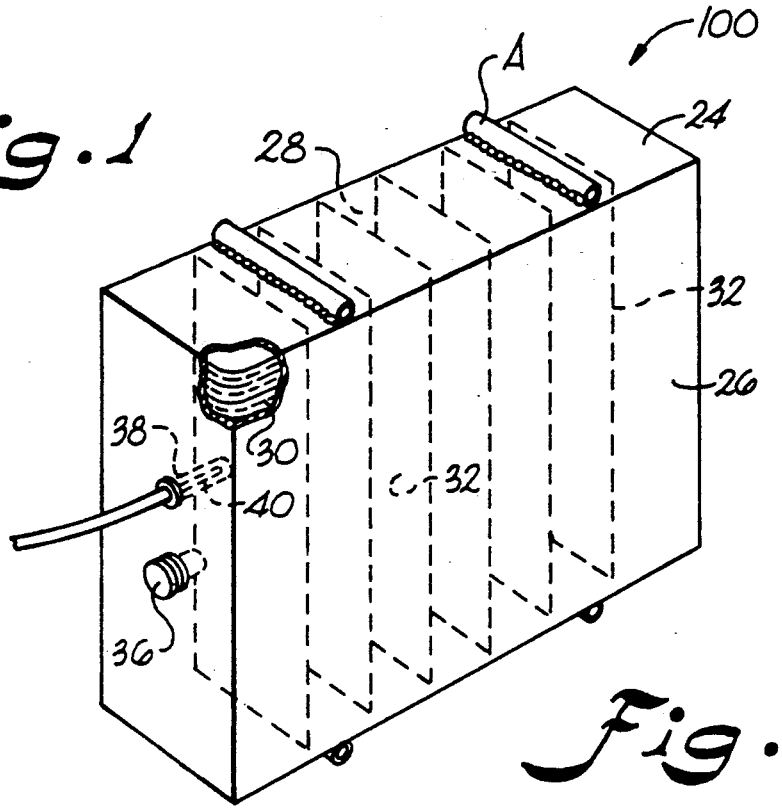
FIG. 1 is a perspective view of the refrigeration holding pack according to the invention. A corner of the holding pack is shown in cut-away view to reveal the eutectic solution therein.

Repeat use of reference characters in the following specification and appended drawings is intended to represent the same or analogous features, elements, or steps of the present invention.

DETAILED DESCRIPTION OF THE PREFERRED EMBODIMENTS

Reference will now be made in detail to the presently preferred embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

Figure 2:
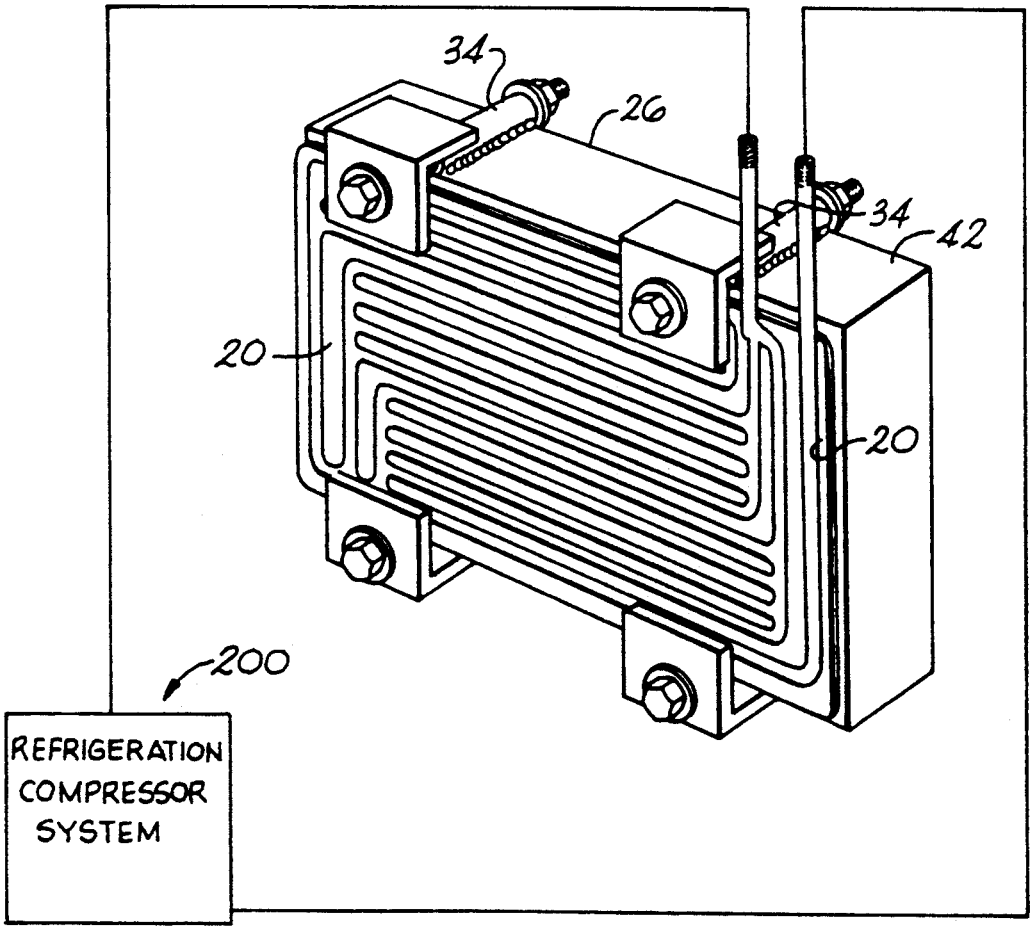
FIG. 2 is a perspective and schematic view of the holding pack according to the invention attached to a refrigeration coil assembly of a refrigeration system. The refrigeration system is illustrated diagrammatically.

Referring to FIGS. 1 and 2, a refrigeration holding pack 100 is provided for use with a refrigeration system 200 employing a refrigeration coil assembly 20 within a refrigeration compartment. The refrigeration compartment in which holding pack 100 may be utilized can be, for example the insulated compartment of a marine vessel, a recreational vehicle, a railroad boxcar, a refrigerated tractor/trailer compartment, or the like. Similarly, the holding pack can provide back-up or primary cooling capability for household refrigeration systems.

In the embodiment depicted in FIGS. 1 and 2, refrigeration coil assembly 20 comprises a component of the existing refrigeration system 200. Coil assemblies and refrigeration systems are well known to those skilled in the art and need not be explained here in great detail. Typically though, the refrigeration coils are contained or housed in a structure such as the box-like structure in FIG. 2. However, this is not a limitation on the present invention and the actual coils may be exposed directly to the insulated compartment or refrigerated space. Operation of holding pack 100 does not depend on the refrigeration coils being housed in a supportive protective structure.

Holding pack 100 comprises sealable plate 24 having first side 28 and second side 26. Sealable plate 24 is essentially a sealed container 42 (FIG. 2) and can be of any desired shape or dimensions. In a preferred embodiment sealable plate 24 or sealed container 42 is rectangular and generally the same size as coil assembly 20 to which it is to be attached. First (contact) side 28 is the side of plate 24 or container 42 which is to be secured against to coil assembly 20. Second side 26 is generally opposite contact side 28. It is generally desired that contact side 28 be relatively flat so as to fit flush against coil assembly 20. It is desired to have maximum surface contact between contact side 28 and coil assembly 20 so as to enhance the heat transfer process between the two components. In a preferred embodiment of the invention, sealable plate 24 or container 42 is made of aluminum. Plate 24 or container 42 may also be made of steel, zinc, stainless steel, or any conventional suitable material.

Holding pack 100 further comprises a plurality of heat transfer fins 32 disposed within plate 24 between contact side 28 and second side 26. In one embodiment, fins 32 are perpendicular to contact side 28 and second side 26 and disposed parallel to each other. Fins 32 may, however, be disposed in any desired pattern within plate 24 such as, for example, a zigzag configuration. In a preferred embodiment, heat transfer fins 32 are welded or otherwise directly attached to contact side 28. Fins 32 may also contact the other side of plate 24, the second side 26, so that heat movement or transfer is not necessarily through the eutectic solution but is through sides 26 and 28 respectively and heat transfer fins 32.

At least on of fins 32 may also be welded or otherwise directly attached to second side 26 and extend to backside 28 so that the same heat transfer process can take place in opposite directions. It should be understood that any combination of heat fins 32 within plate 24 can be considered. For instance, an alternating pattern of heat transfer fins 32 may be employed where alternating fins are welded to contact side 28 and second side 26 respectively. In another embodiment, fins 32 may be welded directly to both contact side 28 and second side 26. This arrangement may be preferred in that it limits or restricts the degree of deformation of plate 24, especially contact side 28, thus keeping plate 24 flat and in full contact with coil assembly 20.

Holding pack 100 further comprises means A for mounting plate 24 to refrigeration coil assembly 20. Mounting means A are configured for removably securing contact side 28 of plate 24 against refrigeration coil assembly 20. In this manner, upon operation of refrigeration system 200, refrigerant (freon, for example) passing through the coil assembly cools the eutectic solution within plate 24. Those skilled in the art will understand that heat transfer fins 32 are important to the cooling of the eutectic solution as they provide a greater heat transfer (cooling) surface area and more efficient thermal conductivity path. When refrigeration system 200 is in operation, the system itself actually cools the refrigerated or insulated compartment while simultaneously cooling or freezing the eutectic solution within plate 24. Once refrigeration system 200 is turned off, plate 24 continues to cool the insulated compartment.

Figure 3:
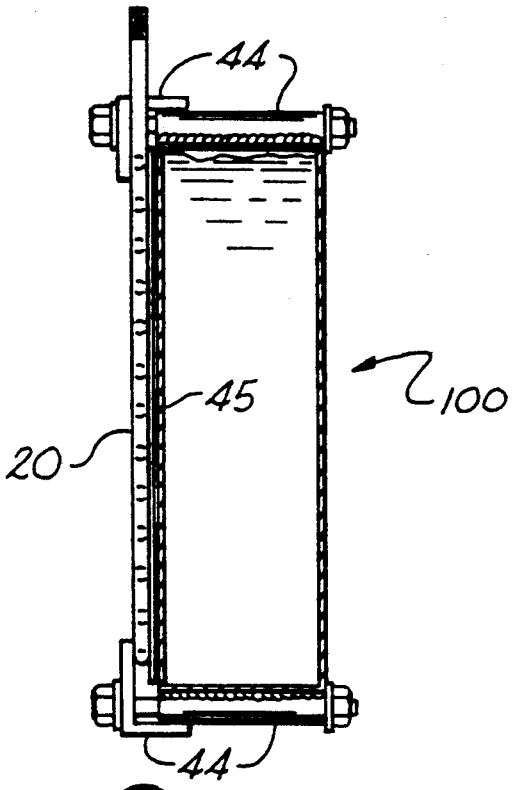
FIG. 3 is a side perspective view of a holding pack according to the invention attached to a refrigeration coil assembly.

Mounting means A preferably may comprise bracket assembly 34 configured to mount contact side 28 flush against refrigeration coil assembly 20. As illustrated in FIGS. 1-3, bracket assembly 34 may comprise a simple bolt and corner brace. Any conventional bracket or attaching assembly may be utilized however. Additionally, any number of bracket assemblies 34 may be utilized, for example the four assemblies 34 as depicted in FIGS. 2 and 3.

Holding pack 100 may preferably contain access port 36 disposed or defined in plate 24. Port 36 is pluggable or sealable with any conventional means, for instance a threaded plug or stopper arrangement. Access port 36 provides a means for filling or draining plate 24 with eutectic solution.

Holding pack 100 may also comprise a sealed thermal well 38 which extends into the interior of plate 24. Thermal well 38 provides a means for monitoring the temperature or condition of the eutectic solution within plate 24 without involving direct contact with the solution. Temperature monitoring device 40, such as a temperature probe or detector, is inserted or fitted into thermal well 38 and provides direct indication of the condition (temperature) of the eutectic solution. Any manner of conventional thermal probes may be utilized.

In one preferred embodiment of the invention, portable recreational refrigeration holding pack 100 also comprises a pre-determined eutectic solution 30 within sealable container 42. Eutectic solution 30 is chosen for its specific thermal characteristics depending upon the purpose for which holding pack 100 is to be used. For example, if it is intended that holding pack 100 be used as a cold storage hold-over device, then eutectic solution 30 would have a freezing point of approximately 30° F. Likewise, if holding pack 100 were to be used as a refrigeration hold-over pack, eutectic solution 30 would have a freezing point approximately in the range of 0° to 30° F. Eutectic solution 30 can be any commercially available solution or mixture of solutions, such as glycol, calcium chloride, or a patented gel mixture. Certain eutectics are caustic to certain types of material and eutectic solution 30 should be chosen with this consideration in mind. For example calcium chloride is a good eutectic solution but tends to be caustic to aluminum. Thus, the choice of eutectic solution 30 depends on the material comprising plate 24 or sealable container 42.

It should be understood that, by having the ability to drain and refill plate 24 through access port 36 with varying eutectic solutions, plate 24 has the beneficial and versatile ability to provide varying degrees of cooling to the same insulated or refrigerated compartment. For example, without changing or modifying refrigeration system 200 in any way, holding pack 100 can provide the associated insulated compartment with a hold-over cooling capability ranging from cold storage to deep freeze merely by changing eutectic solutions 30.

Figure 4:
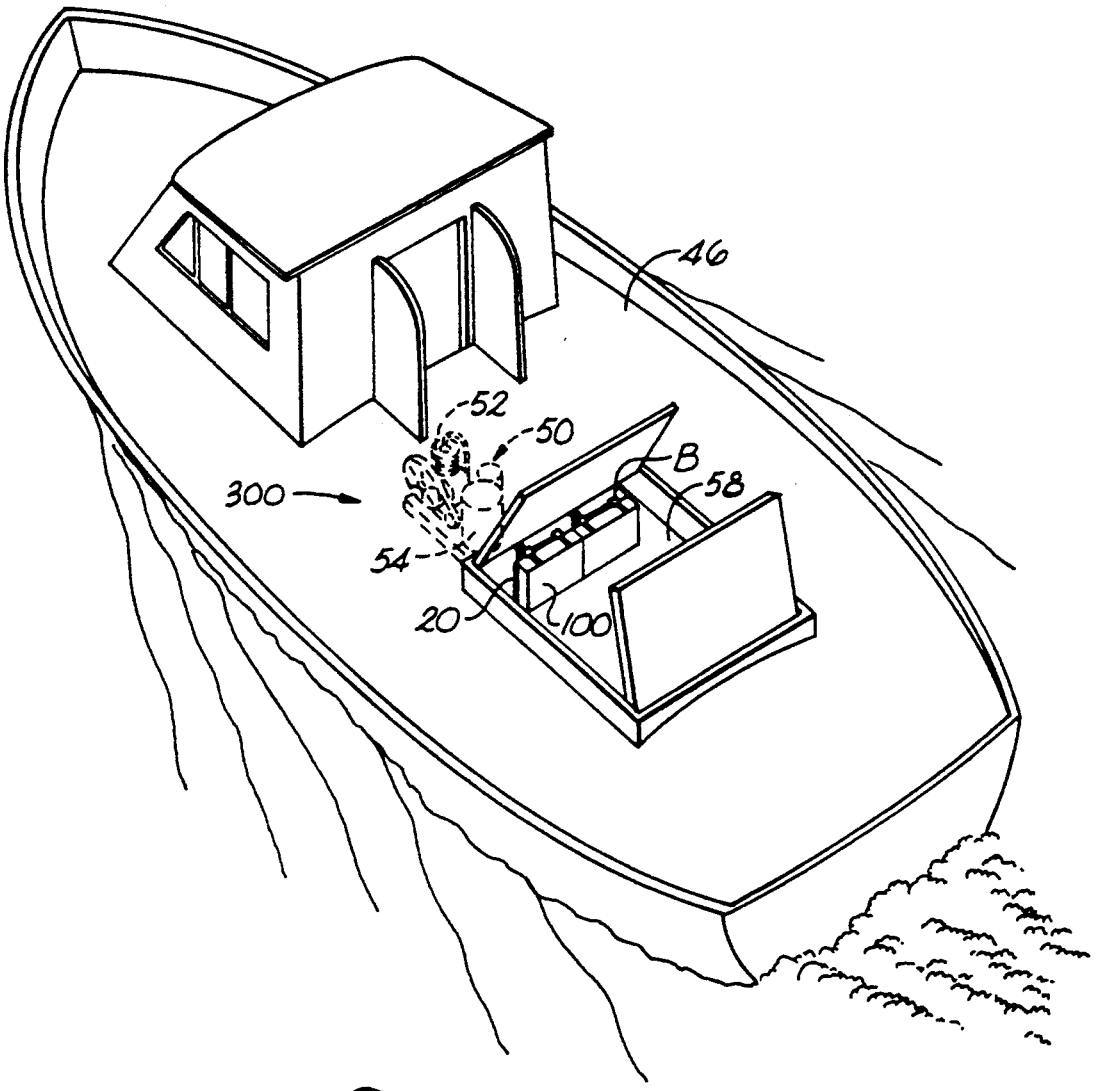
FIG. 4 illustrates the refrigeration system according to the invention in use on a marine vessel.

In another preferred embodiment of the present invention as depicted in FIG. 4, a hold-over refrigeration system 300 is provided for use on recreational vehicles and marine vessels. System 300 is illustrated in FIG. 4 being used to cool an insulated compartment 58 of marine vessel 46, however, this is for illustrative purposes only. It should be understood that system 300 can be employed on any type of recreational vehicle, for instance a motorized RV or camper. Refrigeration system 300 comprises a conventional refrigeration cycle 50. Refrigeration cycle 50 may include compressor 52, condenser 54, refrigeration coil assembly 20, and a refrigerant (e.g. freon) circulated through coil assembly 20 and cooled by operation of condenser 54 and compressor 52. As stated, operation of refrigeration cycle 50 is understood by those skilled in the art and need not be explained here.

Refrigeration system 300 further includes insulated compartment 58 within which is disposed refrigeration coil assembly 20. Insulated compartment 58 can be any conventional refrigerated compartment or cold storage container.

System 300 further includes at least one portable holding pack 100. Holding pack 100 and the components thereof have already been discussed and the explanation thereof is incorporated herein.

In a preferred embodiment of refrigeration system 300, a plurality of holding packs 100 is provided wherein a combination of packs 100 may be removably mounted upon refrigeration coil assembly 20 to provide varying degrees of holdover refrigerating capability to insulated compartment 58. For example, a pair of packs 100 could sandwich coil assembly 20. Compartment 58 can be configured with the proper number of packs 100 to maintain temperatures at a given level for time periods up to several days. In general, the more holding plates, the longer the cooling hold-over capability provided.

In one embodiment of refrigeration system 300, holding pack 100 is portable and securing means B is adapted for removably securing sealable container 42 to coil assembly 20. In this embodiment, securing means B may comprise for example bracket assembly 34 already discussed. In an alternative embodiment of system 300, holding pack 100 is secured to coil assembly 20 with a more permanent type of securing means B. For example, securing means B may include a sealing composition 45 between contact side 28 and coil assembly 20. Sealing composition 45 may comprise for example an epoxy-alumina grit composition.

It will be apparent to those skilled in the art that various modification and variations can be made in the apparatus of the present invention without departing from the scope or spirit of the invention. For example, holding pack 100 need not be rectangular in shape as depicted in the figures but can comprise virtually any configuration or arrangement having a relatively flat contact surface for mounting upon a coil assembly. Thus, it is intended that the present invention cover the modifications and variations of this invention provided they come within the scope of the appended claims and they are equivalent.

What is claimed is:

1. A refrigeration holding pack for use with a refrigeration system employing a refrigeration coil assembly, said holding pack providing nonobtrusive holdover cooling action while remaining external to the refrigeration system, comprising:

a sealable plate having a first side for mounting against the refrigeration coil assembly and a second side, said plate for holding a eutectic solution therein;

a plurality of heat transfer fins disposed within said plate between said first side and said second with at least one of said heat transfer fins disposed in physical contact with said first side; and mounting means for removably securing said plate to the refrigeration coil assembly such that said side first side is in physical contact against said refrigeration coil assembly so that upon operation of the refrigeration system refrigerant passing through the coil assembly cools eutectic solution within said sealable plate, said holding pack thus providing continued cooling action once the refrigeration system is turned off.

2. A refrigeration holding pack as in claim 1, wherein said sealable plate is generally rectangular in shape and said heat transfer fins are disposed within said sealable plate generally transversely between said first side and said second side.

3. A refrigeration holding pack as in claim 2, wherein said sealable plate is aluminum.

4. A refrigeration holding pack as in claim 1, wherein said heat transfer fins are parallel relative each other and in physical contact with said first side and said second side.

5. A refrigeration holding pack as in claim 1, wherein said mounting means comprises a bracket assembly affixed to said sealable plate, said bracket assembly configured to mount said first side of said plate flush against the refrigeration coil assembly.

6. A refrigeration holding pack as in claim 1, wherein said sealable plate further comprises an access port disposed therein, said access port for allowing said sealable plate to be selectively filled and drained with an eutectic solution.

7. A refrigeration holding pack as in claim 1, wherein said sealable plate further comprises a sealed thermal well extending into said sealable plate and within which may be inserted a temperature monitoring device for determining the thermal condition of said eutectic solution within said sealable plate.

8. An improved portable recreational refrigeration holding pack compatible with a recreational refrigeration system employing a refrigeration coil assembly, said improved holding pack providing nonobtrusive enhanced hold-over cooling capability to the recreational refrigeration system while remaining external to the refrigeration system, comprising:

a sealable container having a contact side and a front side;

a plurality of heat transfer fins disposed within said sealable container, at least one of said heat transfer fins being in physical contact with said contact side;

an eutectic solution within said sealable container, said eutectic solution having predetermined thermal characteristics suited for the purpose said holding pack is to be used for;

a pluggable access port disposed in said sealable container for selectively filling and draining said sealable container with said eutectic solution; and a mounting device operatively affixed to said sealable container for removably securing said contact side of said sealable container against the refrigeration coil assembly within the refrigerated compartment so that upon operation of the refrigeration system, refrigerant passing through the refrigeration coil assembly absorbs heat from said eutectic solution within said sealable container thereby causing said eutectic solution to cool a predetermined amount depending on the thermal characteristics of said eutectic solution, whereby said holding pack will continue to cool the compartment when the refrigeration system is turned off.

9. A holding pack as in claim 8, wherein said holding pack is a cold storage hold-over pack, said eutectic solution freezing at a predetermined temperature to provide cold storage hold-over capability.

10. A holding pack as in claim 8, wherein said holding pack is a refrigeration hold-over pack, said eutectic solution freezing at a predetermined temperature to provide refrigeration hold-over capability.

11. A holding pack as in claim 8, wherein said holding pack is a freezer hold-over pack, said eutectic solution freezing at a predetermined temperature to provide freezer hold-over capability.

12. A holding pack as in claim 8, wherein said holding pack is a deep-freeze hold-over pack, said eutectic solution freezing at a predetermined temperature to provide deep-freeze hold-over capability.

13. A hold-over refrigeration system for use on recreational vehicles and marine vessels, comprising:

a refrigeration cycle, said refrigeration cycle further comprising:

a compressor;

a condenser in operative communication with said compressor;

a refrigeration coil assembly in operative communication with said compressor and said condenser; and refrigerant circulated through said coil assembly and cooled by operation of said condenser and said compressor;

an insulated compartment, said refrigeration coil assembly disposed within said insulated compartment;

at least one holding pack, said holding pack adapted to be mounted externally upon said refrigeration coil assembly, said holding pack comprising:

a sealable container having a contact side and a front side;

a plurality of heat transfer fins disposed within said sealable container, at least one of said heat transfer fins being in physical contact with said contact side;

an eutectic solution stored within said sealable container, said eutectic solution having predetermined thermal characteristics;

a pluggable access port disposed within said sealable container for selectively filling and draining said sealable container with said eutectic solution; and fastening means operatively affixed to said sealable container for securing said contact side of said container against said refrigeration coil assembly, so that upon operation of said refrigeration cycle, said refrigerant circulating through said refrigeration coil assembly cools said insulated compartment and simultaneously absorbs heat from said eutectic solution within said sealable container thereby causing said eutectic solution to cool a desired amount, said holding pack thereby providing hold-over cooling capability to said insulated compartment once said refrigeration cycle is turned off.

14. A refrigeration system as in claim 13, further comprising a plurality of said holding packs wherein a combination of said holding packs may be removably mounted upon said refrigeration coil assembly to provide varying degrees of hold-over refrigerating capability to said insulated compartment.

15. A refrigeration system as in claim 13, wherein said holding pack is portable and said securing means comprises means for removably securing said sealable container to said coil assembly.

16. A refrigeration system as in claim 13, wherein said securing means includes a sealing composition between said contact side and said coil assembly.

17. A refrigeration system as in claim 16, wherein said sealing composition includes an epoxy-alumina grit composition.

* * * * *